US005222789A

United States Patent [19]

Yoshikawa

[11] Patent Number: 5,222,789

[45] Date of Patent: Jun. 29, 1993

[54] DRAWER SYSTEM

[76] Inventor: Koichi Yoshikawa, 1-10, Namiyose-cho, Atsuta-ku, Nagoya-shi, Aichi-ken, Japan

[21] Appl. No.: 800,309

[22] Filed: Nov. 29, 1991

[30] Foreign Application Priority Data

Nov. 29, 1990 [JP] Japan ..... 2-127870[U]

[51] Int. Cl.[5] ..... A47B 88/04

[52] U.S. Cl. ..... 312/270.3; 312/273

[58] Field of Search ..... 312/270.3, 273

[56] References Cited

U.S. PATENT DOCUMENTS 589,159 8/1897 Burt ..... 312/270.3 X 3,982,799 9/1976 Murray ..... 312/270.3 X 4,021,088 5/1977 Murray ..... 312/270.3 X

*Primary Examiner*—Peter R. Brown

*Attorney, Agent, or Firm*—Edwin E. Greigg; Ronald E. Greigg

[57] ABSTRACT

This invention is directed to a drawer system including a roll-up device comprising a core cylinder and a sheet to cover the upper open surface of a drawer in which the sheet is rolled up onto the core cylinder by elasticity. The sheet roll-up device is placed above the entrance of the drawer and the end of the sheet is secured to the top back side of the drawer so that the sheet can be drawn out from the sheet roll-up device against the elasticity to cover the open surface of the drawer and the articles therein when the drawer is pushed inside of the entrance, when the drawer is moved outwardly the sheet is rolled onto the roll-up device by the elasticity. Rollers may be placed on the ends of the core cylinder which rotate to feed the sheet out or to feed the sheet onto the drawer as the drawer is moved in and out.

2 Claims, 4 Drawing Sheets

DRAWER SYSTEM

BACKGROUND OF THE INVENTION

This invention relates to a drawer system in which a drawer filled with contents can be moved in and out smoothly.

As is well known in the prior art, a drawer fixed to a desk or a wardrobe is planned so that it is convenient to place in and remove books, clothes or notions.

However, in case that a top-open drawer is full of contents or the contents are projecting upward, the contents suffer rumples or a mass in their upper surface, or sometimes the contents overflow backward of the drawer without being noticed by which one is upset because of a mistaken idea that the contents are lost.

The present invention provides an improved drawer system in order to overcome the above problems.

SUMMARY OF THE INVENTION

A drawer system of the present invention comprises a sheet roll-up device including a core cylinder with a retractable sheet that covers the upper surface of a drawer along which the sheet is rolled up onto said core cylinder by elasticity. The sheet roll-up device is placed above the entrance of the drawer and an end of said sheet is connected to the back wall of the drawer, wherein said sheet is drawn out against the elasticity to cover the surface of the drawer when the drawer is pushed inside of the entrance. The sheet is then rolled onto said sheet roll-up device by the elasticity when the drawer is withdrawn.

In another case, rollers are fixed to both ends of a core cylinder of a sheet roll-up device and placed on the upper surface of the side walls of a drawer. In this construction, as the rollers roll accompanied with movement of the drawer, the sheet is rolled up on to said sheet roll-up device or drawn out from it.

In the above mentioned drawer system, when a drawer is being enclosed in a housing frame, the upper surface of the drawer is covered with an extended sheet and the contents are prevented from projecting upward or flowing backward. As the sheet is rolled up gradually when the drawer is drawn forward, the sheet does not cause any trouble in movement of the drawer. In addition, even in case the drawer is full of contents, the sheet works just as a conveyer to convey the contents placed in the upper space of the drawer forward or backward accompanied with movement of the sheet when the drawer is drawn forward or backward.

BRIEF DESCRIPTION OF THE DRAWINGS

FIG. 1 is an analyzed perspective view of a sheet roll-up device;

FIG. 2 is a perspective view of a drawer;

FIGS. 3 and 4 are section views of a drawer in use illustrated without end rollers;

FIGS. 5 and 6 show another embodiment of a drawer system of the present invention; wherein, FIG. 5 is a perspective view of a sheet roll-up device; and FIG. 6 is a section view of a drawer in use.

DETAILED DESCRIPTION OF THE PREFERRED EMBODIMENT

An embodiment of a drawer system of the present invention is described hereinafter with reference to the drawings.

Figure 1:
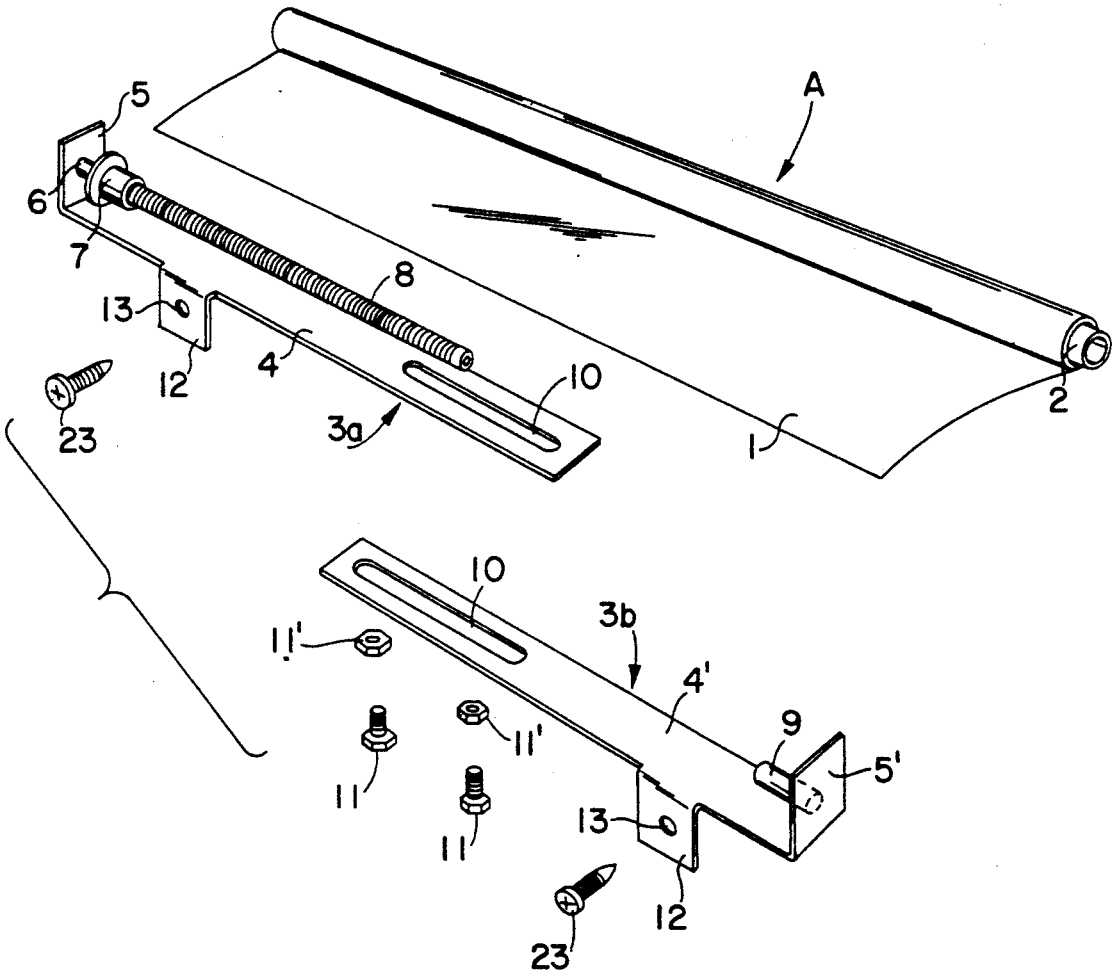
FIGS. 1 through 4 show an embodiment of a drawer system of the present invention.

FIG. 1 is an analyzed perspective view of a sheet roll-up device A. Numeral 1 is a rectangular sheet made of material such as flexible plastic one end of which is fixed to a core cylinder 2 so to be rolled up and the core cylinder 2 is made of plastic.

Numeral 3*a*, 3*b* are holders which are symmetrical with each other comprising band plates 4, 4' and vertical walls 5, 5' provided at the outer edge of the band plates 4, 4' at 90 degree angle relative to the band plates 4, 4'. One end of a supporting lever 6 of a predetermined length is fixedly connected to the inner surface of the vertical wall 5 so as to be parallel to the band plate 4. The other end of the lever 6 is fixedly engaged with one end of a coil spring 8 and the opposite end of the coil spring 8 is fixed to a collar 7 which is rotatable on the lever 6. Onto the inner surface of another vertical wall 5', a supporting lever 9 is provided at the corresponding position to the supporting lever 6 and it is parallel to the band plate 4.

Further, one end of the core cylinder 2 to which the sheet 1 is rolled up is engaged with the collar 7 which is rotatable on the supporting lever 6, and the other end of the core cylinder 2 is movably engaged with the supporting lever 9. By this construction, the sheet 1 tends to be rolled up on to the core cylinder 2 by means of the resilience of the coil spring 8.

Further, long perforations 10, 10 are provided near the inner ends of the band plates 4, 4'. The long perforations 10, 10 are overlapped and fixed to each other with nuts 11', 11' by machine screws 11, 11, so that the distance between 5 and 5' is maintained the length of the core cylinder 2. Numeral 12, 12 are projecting pieces at the side edge of 4, 4' and have perforation 13, 13.

Figure 2:
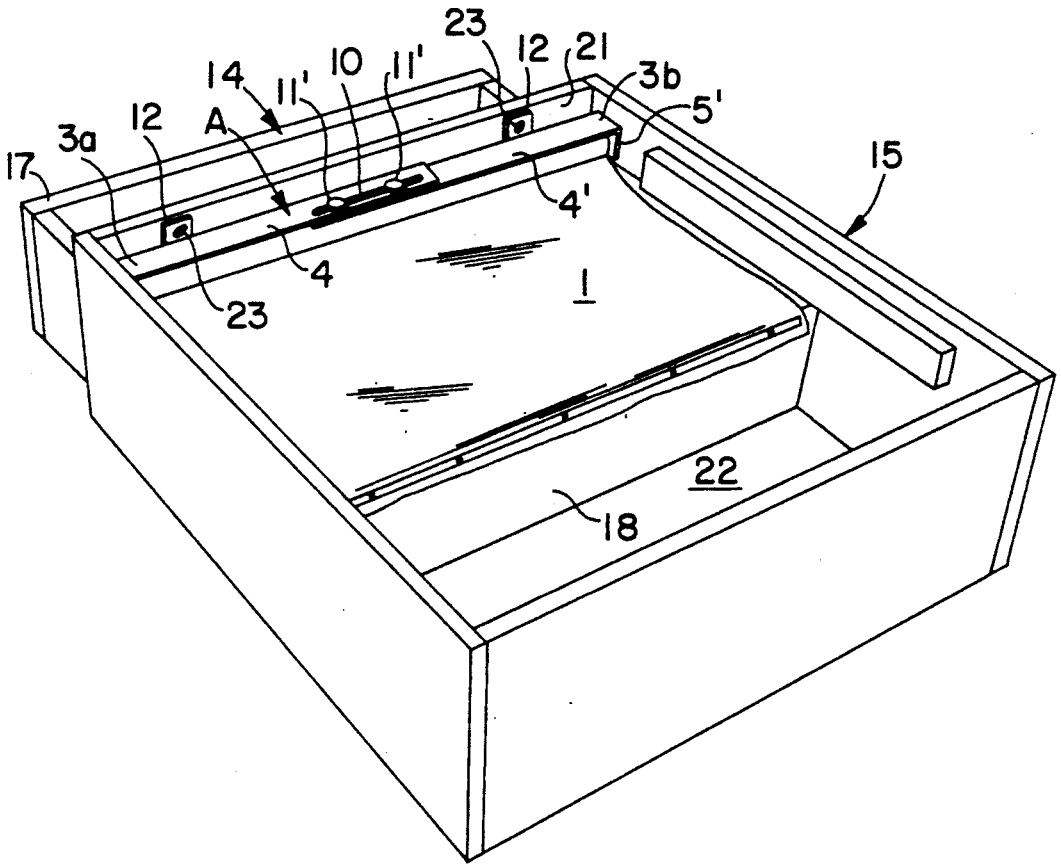
Figure 3:
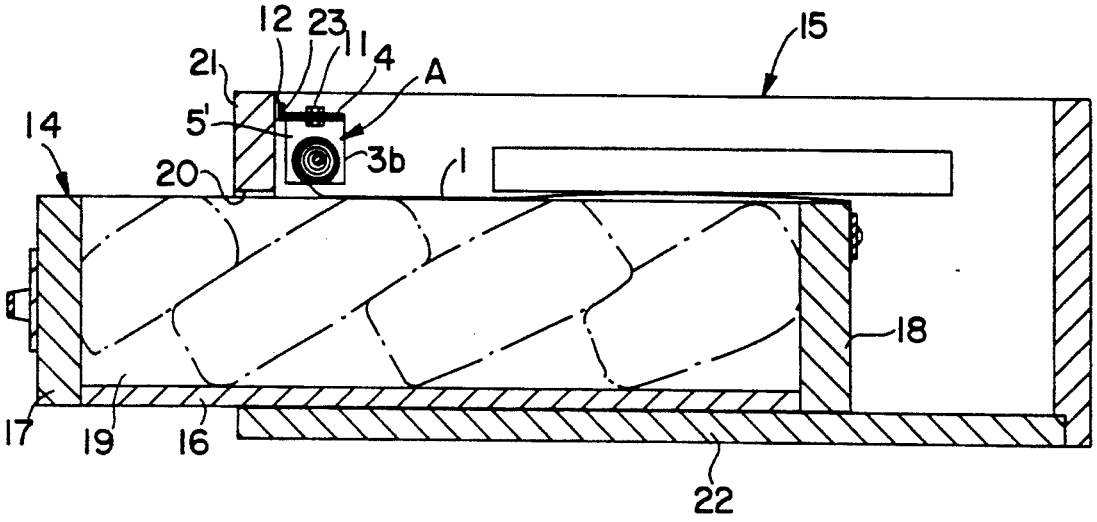
Figure 4:
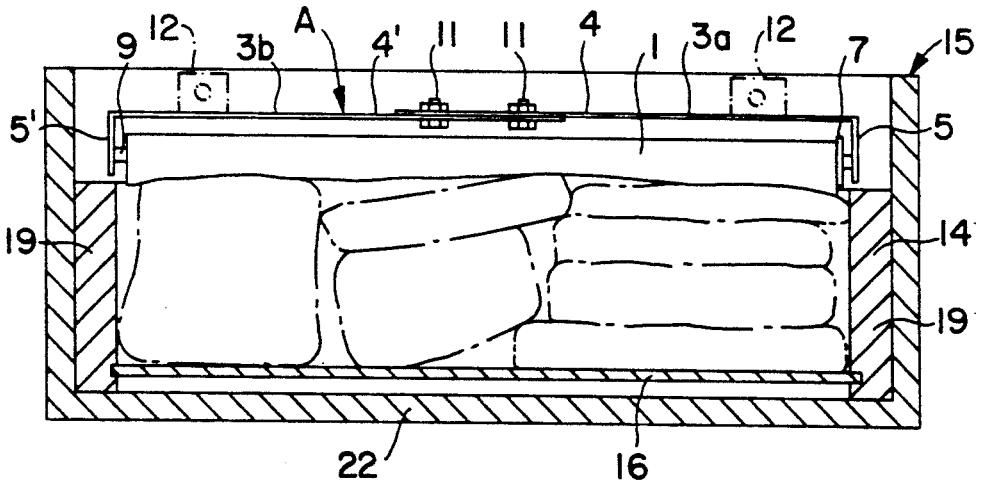

Numeral 14 is a drawer of which the top is open and numeral 15 is a housing frame of the drawer 14. The drawer 14 comprises a bottom wall 16, and a front wall 17, a back wall 18, a left side wall 19 and a right side wall 19, each of which is provided on each side of the bottom wall 16. As shown in FIGS. 2 and 3, the housing frame 15 comprises a bar 21 provided above an entrance 20 and a receiving plate 22 which supports the bottom wall 16 slidably. The sheet roll-up device A is placed inside of the bar 21 horizontally and fixed to the bar 21 at the projecting pieces 12 by means of screws 23.

The end of the sheet 1 to be drawn out from the sheet roll-up device A is fastened to the edge of the back wall 18 so that the sheet covers over the top surface of the drawer 14 when the drawer 14 is enclosed in the housing frame 15.

Furthermore, the width of the sheet 1 and the length of the core cylinder 2 corresponding thereto can be cut down so as to be the same as the width of the drawer 14. The length of the sheet 1 can also be cut down so as to be the same length as the length of the drawer 14. The distance between the verical walls 5, 5' is determined by sliding the band plates 4, 4'. The length of the supporting lever 6 is kept shorter than that of the core cylinder 2 in order to prevent any trouble in sliding the band plates 4, 4'.

In the above mentioned drawer system, when the drawer 14 is being enclosed in the housing frame 15, the upper surface of the drawer is covered with the extended sheet 1 and the contents are prevented from projecting upward or overflowing, especially a thin paper is prevented from dropping off to the back of the back wall 18.

As the sheet 1 is rolled up gradually when the drawer 14 is withdrawn, the sheet does not cause any trouble in the movement of the drawer.

In addition, even in case the drawer 14 is full of contents, the sheet 1 works just as a conveyor to convey the contents placed in the upper space in the drawer 14 forward or backward accompanied with the sheet 1 as the drawer 14 is drawn forward or backward.

The sheet roll-up device A may be fixed to the sides of the housing frame 15 instead of being fixed to the bar 21.

Figure 5:
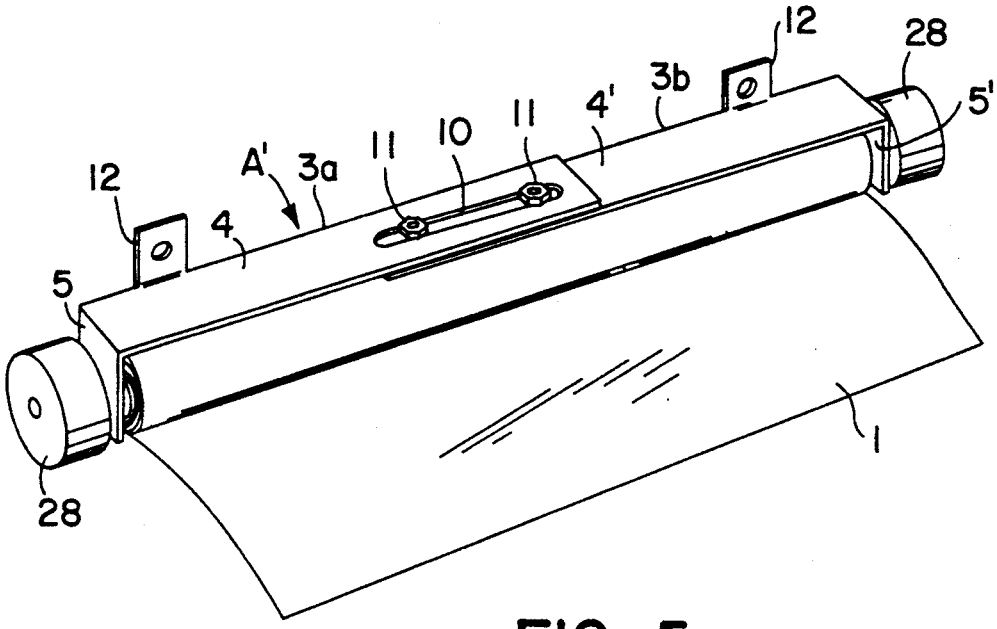
Figure 6:
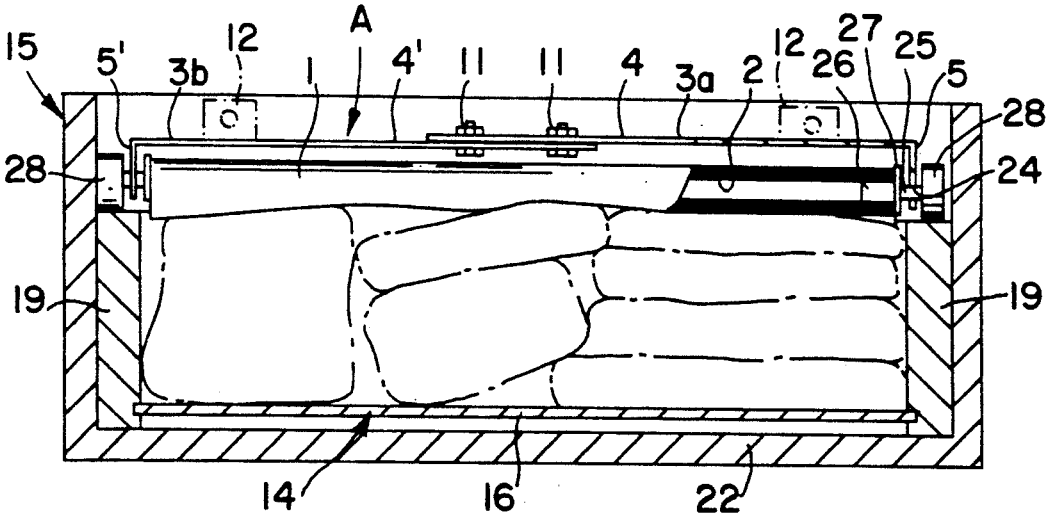

FIG. 5 shows a sheet roll-up device A' of the second embodiment of the present invention. Vertical walls 5, 5' have perforations 24, 24 through which a core shaft 25 projects outside of the vertical walls 5, 5' and each end of the core shaft 25 is connected to a roller 28. A projecting part 26 of a supporting member 27 is engaged with the core cylinder 2. The rollers 28, 28 on the end of the core might be substituted with knurling rollers to prevent slipping.

In this embodiment, the rollers 28, 28 are placed on the upper surface of the side walls 19, 19 of the drawer 14. In this condition, the rollers 28, 28 roll accompanied by the movement of the drawer 14 and cause the sheet 1 to be extended or rolled-up.

The sheet roll-up device A' in this embodiment need not attach said coil spring 8 to the supporting bar 6. Further, the supporting bar 6 can be shorter.

Further, several pieces of a bendable and elastic band of narrow width may be attached to said sheet 1 along a longitudinal direction, which increases the effect to push down contents inside of the drawer 14.

Furthermore, said sheet is not necessarily made of elastic plastic but may be made of other material if only it could be rolled up and it could cover the upper surface of the drawer.

The foregoing relates to a preferred exemplary embodiment of the invention, it being understood that other variants and embodiments thereof are possible within the spirit and scope of the invention, the latter being defined by the appended claims.

I claim:

1. A sheet roll-up device for attaching to an upper inside wall of an opening which receives a drawer and a covering material which is to be attached to the drawer for covering items stored in the drawer, said sheet roll-up device includes first and second elongated band plates (4, 4'), each of said first and second elongated band plates includes a long perforation (10) which overlaps each other for securing the first and second elongated plates together and for adjustment of a total length by use of bolts that pass through said long perforations, each of said first and second elongated band plates includes first and second end walls (5, 5') which are perpendicular to the band plates and which face in the same direction, a first end of a first rod (6) is secured to said first end wall (5) and extends parallel with said first band plate, a coil spring (8) is fixedly secured at a first end to a second end of said first rod (6), said coil spring surrounds said second end of said first rod (6) and is secured at a second end to a rotatable collar (7) juxtaposed over said first end of said first rod (6), said rotatable collar rotates on said first rod (6), a supporting second rod (9) is secured to said second end wall (5') in alignment with said first rod (6), said device includes a core cylinder, said core cylinder is slid over said rod (6) and said coil spring (8), with a first end of said core cylinder tightly engaging said collar (7) for rotation with said collar, a second end of said core cylinder is fitted onto said second rod (9) for rotation about said second rod (9), a covering material is secured along a first end onto said core cylinder and rolled onto said core cylinder, said first and second band plates are secured together via said long perforations and bolts with one end of said core cylinder secured onto said collar (7) and a second end of said core cylinder fitted onto said second rod (9), and each of said band plates includes projecting tabs (12), each of which includes perforations (13) through which screws are passed to secure said sheet roll-up device onto an inside upper wall of said drawer opening, above a drawer slid into said drawer opening with a second end of said covering material secured to a back wall of said drawer opening.

2. A sheet roll-up device as set forth in claim 1 in which said second end of said covering material is secured to said back panel of said drawer to extend across a width of said drawer, whereby the covering material is rolled off said core cylinder as said drawer is forced into the drawer opening and said covering material is rewound onto said core cylinder as said drawer is withdrawn from said drawer opening.

* * * * *